United States Patent [19]

Greene et al.

[11] Patent Number: 4,595,024

[45] Date of Patent: Jun. 17, 1986

[54] SEGMENTED CIGARETTE

[75] Inventors: Tammie B. Greene; David E. Townsend; Thomas A. Perfetti, all of Winston-Salem, N.C.

[73] Assignee: R. J. Reynolds Tobacco Company, Winston-Salem, N.C.

[21] Appl. No.: 646,329

[22] Filed: Aug. 31, 1984

[51] Int. Cl.[4] ..... A24D 1/00

[52] U.S. Cl. ..... 131/77; 131/363; 131/364

[58] Field of Search ..... 131/66 A, 84 R, 84 C, 131/84 A, 84 B, 363, 364, 66.2, 84.1, 84.2, 84.3, 84.4, 77, 78

[56] References Cited

U.S. PATENT DOCUMENTS

| | | | |
|---|---|---|---|
| 1,796,522 | 3/1931 | Hopkins | 131/364 |
| 1,920,708 | 8/1933 | Molins | 131/66 A |
| 3,604,429 | 9/1971 | DeWitt | 131/280 |
| 3,664,350 | 5/1972 | Wall | 131/331 |
| 3,759,267 | 9/1973 | Thornton | 131/363 |
| 3,773,053 | 11/1973 | Stephens | 131/363 |
| 3,902,504 | 9/1975 | Owens et al. | 131/363 |
| 3,916,914 | 11/1975 | Brooks et al. | 131/331 |
| 4,009,722 | 3/1977 | Wahle et al. | 131/110 |
| 4,328,817 | 5/1982 | Naylor et al. | 131/360 |
| 4,434,804 | 3/1984 | Bolt et al. | 131/363 |
| 4,516,585 | 5/1985 | Pinkham | 131/84.1 |

*Primary Examiner*—V. Millin

*Attorney, Agent, or Firm*—Grover M. Myers

[57] ABSTRACT

A cigarette, having a tobacco rod consisting of at least two segments. The segment toward the filter end of the tobacco rod has a density at least 20% greater than the fire-end segment. The density differential may be combined with a nicotine differential, such that the fire-end segment has a higher nicotine content than does the filter-end segment. This configuration alters the nicotine delivery of the invention, providing a nicotine delivery either uniform during the last half of the cigarette or at levels reduced from those seen during the first few puffs.

31 Claims, 7 Drawing Figures

SEGMENTED CIGARETTE

BACKGROUND OF THE INVENTION

This invention relates to cigarettes, and more particularly to cigarettes having segments or zones, each segment or zone comprising a tobacco having characteristics different from that of the other segments or zones.

A significant problem facing the cigarette industry is the development of new products. One area for cigarette improvement is the general perception of smokers that cigarettes tend to become more "harsh" as the cigarette is consumed. Another area for significant improvement would be the development of a cigarette that delivers full smoking "satisfaction" at "tar" and nicotine levels below those made possible by the current technology. The present invention points the way to the development of products that meet both those needs.

Understanding of the invention will be enhanced by brief consideration of some basic principles. First, a smoker experiences cigarette smoke as a discrete series of puffs, not in terms of the total cigarette characteristics. Further, it is recognized that smoking characteristics, in terms of the "tar" and nicotine contained in the smoke, very from the first puff to the last, with both measures increasing generally linearly with each puff. One explanation for this phenomenon is the deposition of "tar" and nicotine from early puffs on the tobacco toward the rear of the cigarette. The recurring process of deposition and revolatilization produces smoke higher in these constituents as the product is consumed. It also has been generally recognized that the smoker's perception of the "strength" of the cigarette is directly related to the amount of nicotine contained in the cigarette smoke during each puff.

The only solution offered by the prior art is to vary the nicotine content of portions of a cigarette. Disclosures suggest a multi-blend cigarette, having two separate tobacco blends—a high-nicotine blend at the front of the cigarette and a low-nicotine blend toward the rear. This arrangement is said to overcome the increase in nicotine delivery in the last few puffs and provide more uniform delivery during smoking. This approach was first propoed in British Pat. No. 250,063, in 1925. Similar disclosures include those of Thornton, in U.S. Pat. No. 3,759,267; Wahle, in U.S. Pat. No. 4,009,722; Beretz, in French Patent Application No. 79 20341; and in Brazilian Patent Application No. 820879. Other disclosures, discussing the use of tobacco substitutes instead of low-nicotine tobacco toward the rear of the cigarettes include that of Owens, U.S. Pat. No. 3,902,504.

All of these disclosures share two traits. First, modification of smoking characteristics is defined as being possible solely through varying the nicotine level between front and rear segments, with no other factors involved. Second, no commercially viable product has ever been introduced employing the inventions disclosed.

One inventor realized that density could play a role in smoke modification, but he did so incorrectly. In U.S. Pat. No. 4,328,817, Naylor disclosed a cigarette in which tobacco density preferably decreases continually along the rod from front to rear. Naylor rejected any other configuration. These cigarettes are said to reduce total particulate matter delivered by the cigarette, but no modification of per-puff deliveries is suggested. As will be seen, Naylor teaches directly away from the present invention.

Otherwise, the only application of density control to cigarette manufacturing has been the so-called "dense ending" technique, whereby the ends of the tobacco rod are compacted during rod formation in order to reduce the amount of tobacco spilling from those open ends during manufacture or use. Typical of such disclosures is U.S. Pat. No. 3,604,429. Conventional equipment produces a relatively dense area in both ends of the tobacco rod, with a length of up to about 12½ mm. maximum, or about 25% of the rod length.

The prior art eloquently testifies to the failure of the industry to develop a successful cigarette offering modification of conventional delivery patterns. The present invention meets that long-felt need.

SUMMARY OF THE INVENTION

It is an object of this invention to provide a cigarette having a puff-by-puff nicotine delivery curve radically different from that of a conventional cigarette.

It is a further object of this invention to provide a cigarette which delivers a larger amount of nicotine in the first few puffs of the cigarette than in the last few puffs.

Another object of this invention is to provide a cigarette whose nicotine delivery is essentially uniform during the middle to last puffs.

These and other objects are accomplished in the present invention by providing a segmented cigarette, with a filter-end segment having a density at least 20% greater than the fire-end segment. This density differential may be combined with a nicotine differential, such that the fire-end segment has a higher nicotine level than does the tobacco of the filter-end segment. In either instance, the delivery of nicotine to the smoker is radically altered from that of conventional cigarettes. During the first few puffs of a cigarette made according to the present invention, the nicotine delivery increases, as in a conventional product. Thereafter, however, nicotine delivery either remains constant for the remainder of the cigarette, or is reduced to lower levels, a result dramatically different from the prior art. In this manner, the invention offers to smokers products which do not become "harsh" toward the end of the cigarette, or products which are perceived as being very "strong" at the beginning of consumption, but less "strong" at the end of the cigarette.

DETAILED DESCRIPTION OF A PREFERRED EMBODIMENT

Figure 1:
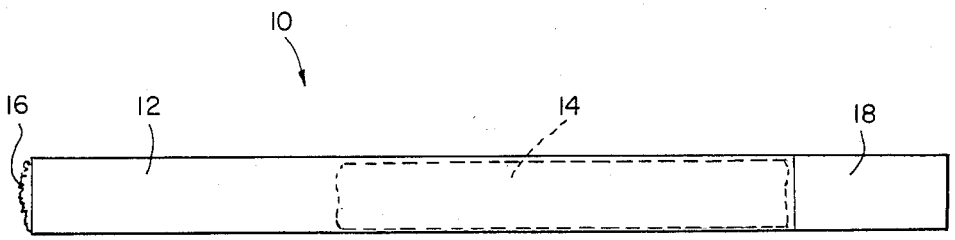
FIG. 1 is a cross-section of an embodiment of the present invention.

FIG. 1 shows an embodiment 10 of the present invention. As shown, this cigarette has an appearance similar to a conventional filter cigarette, having a filter 18 and (as would be seen in use) a fire cone 16. Hereinafter, the end of the cigarette disposed toward the fire cone will be referred to as the "fire end", and the end toward the filter will be referred to as the "filter end." It should be understood, of course, that the invention may be embodied in a non-filter cigarette, in which case the filter 18 would be absent. In that event, some type of marking on the product's outer wrapper could be used to designate the respective ends of the products, because those ends should be maintained in the arrangement shown, as will be seen. Also in that event, the term "filter end" should be understood as referring to the unlit end of the cigarette. Further, it should be understood that the invention applies to all smoking articles. The embodiment shown is a cigarette.

The tobacco within the cigarette comprises two smokeable charges forming separate segments, a fire-end segment 12 and a filter-end segment 14. The composition of these segments is discussed in detail below.

Preferably, this cigarette is manufactured on the apparatus disclosed in U.S. Pat. No. 4,009,722, to Wahle. As seen in that patent, conventional cigarette-making apparatus is modified to produce a multi-segment cigarette. Two feeding mechanisms are employed, one feeding the fire-end blend and the other feeding the filter-end blend. A first blend is fed to a pocket wheel, which forms discrete portions of that blend on the cigarette maker's perforated tape. The apparatus may be set up to position the first blend segment at either end of the cigarette. As the portions thus formed travel down the perforated tape, the remainder of the tobacco rod is formed between those portions and is commposed of the second blend. Trimming removes all but a thin layer of the second blend from atop the first-blend segment, and the cutting knife is set to cut the tobacco rod into individual cigarettes. The resulting product contains two segments, one composed predominantly of the first blend with a small portion of the second blend overlying it, and the other composed entirely of the second blend.

The Wahle apparatus can be set up to produce cigarettes of various configurations. A primary determinant of the cigarette perfomance is the tobacco selection, as this selection is the principal contributor to the nicotine and density differentials between the segments. Wahle himself offers little guidance beyond the prior art teaching of nicotine variation. Among the suitable tobaccos available, one could select tobaccos to yield a wide variety of nicotine and density differentials. Additionally, the choice of positioning the first blend as the fire-end or filter-end segment influences density, as the volumetric feed associated with the pocket wheel tends to increase the density of that segment over that seen in the weight-controlled feed of the conventional portion of the machine.

Although other apparatus for producing multi-segment cigarettes have been disclosed, it is preferred to use the Wahle apparatus, as it has proved to be the most feasible. Other disclosures which discuss apparatus said also to produce such cigarettes include those of Naylor, U.S. Pat. No. 3,889,171 and Hopkins, U.S. Pat. No. 1,721,117. Should such apparatus prove feasible, one could produce a segmented cigarette following the teachings of the present invention using such equipment.

The embodiment shown in FIG. 1 incorporates two startling discoveries. First, when the filter-end segment is more dense than the fire-end segment, a modification of nicotine delivery occurs, with no nicotine differential present. Second, when the two factors were combined—that is, when the fire-end blend is both higher in nicotine and lower in density than the filter-end segment, a synergistic effect results in accentuating the alteration of the nicotine delivery curves.

The cigarette 10 of FIG. 1 embodies the present invention. As described in greater detail hereafter, this cigarette has two segments, the fire-end segment and the filter-end segment. The fire-end segment contains a higher level of nicotine and has a lower density than does the filter-end segment. The Wahle apparatus was set to position the first blend (deposited by the pocket wheel) in the filter-end segment.

Each segment exhibits substantially uniform density throughout the length of the segment. The boundary between segments is relatively abrupt, providing rapid transition from one tobacco type to another. Conventional dense-ending apparatus may be employed to control tobacco spillage, as is known in the art. It should be understood that the term "substantially uniform density" refers to that portion of the segment apart from the "dense ends", should such apparatus be employed. Further, other design criteria known to the art, such as selection of an appropriate filter, paper, etc., also may be employed in designing the product. It is preferred to use a cellulose acetate filter and flax-base paper to construct the embodiment depicted.

An important characteristic of the product is the ratio between the sizes of the fire-end and filter-end segments. Different size segments can be produced, for example, by altering the dimensions of the pockets on the Wahle device pocket wheel. Maximum utilization of the present invention is made, of course, when the segments are the same size, each occupying 50% of the tobacco rod length. For best taste delivery, however, it may be preferable to alter that distribution somewhat. If conventional "dense-end" apparatus is employed, the smaller segment must be at least 30% of the tobacco rod length to provide a uniform segment beyond the "dense-end". It is preferred that the fire-end segment be approximately 40% of the tobacco rod length, and the filter-end segment be about 60% of the rod length.

The blends for each segment should be selected with primary regard to nicotine content and density. Taste characteristics also are a factor, as is known to the art. It is preferred to use a blend including a substantial amount of puffed, tobaccos in the fire-end segment and a blend having a substantial amount of Turkish tobaccos at the filter end, both being blended with conventional cigarette tobaccos as known in the art. Casing materials and top dressing may be added, in accordance with normal manufacturing practice. It is preferred to employ density differentials in a range of 20% to 40%, preferably about 39%, and nicotine differentials in the percentage of between 0 to 21%, preferably 19%. (The embodiment exhibiting a density differential of 39% and a nicotine differential of 19% is referred to hereinafter as Embodiment 1). An alternate embodiment (referred to hereafter as embodiment 2) exhibits a density differential of 24% and a nicotine differential of 4%. Using standard measurement techniques (the "FTC" method, which measures the total amounts of "tar" and nicotine delivered by a cigarette), these products yield 10.0 mg. and 12.3 mg. "tar" and 0.78 mg. and 0.98 mg. nicotine, respectively.

The following data illustrate the application and efficacy of this invention. In order to isolate and investigate the effects of nicotine and density differentials, it was necessary to design a series of special test products, using tobaccos that would allow for a range of density and nicotine differentials. Table I sets out the tobaccos used in the test products. As can be seen there, pure tobaccos—rather than blends—were chosen to allow for predictability and uniformity. For the same reasons, no top dressing or casing materials were applied, and "dense-ending" techniques were not employed. Two variations of a low density tobacco were used, one having high nicotine content and the other a low nicotine content. Puffed, flue cured tobacco was used for both of these tobaccos, appropriately selected for the desired nicotine content. For a high density, low nicotine tobacco, Turkish tobacco was selected. Additionally, serving as a control, a conventional cigarette blend also was selected.

TABLE I

| TOBACCOS USED FOR TEST CIGARETTES | |
|---|---|
| LDHN: | Low Density, High Nicotine<br>100% Puffed, Flue-cured Tobacco |
| LDLN: | Low Density, Low Nicotine<br>100% Puffed, Flue-cured Tobacco |
| HDLN: | High Density, Low Nicotine<br>100% Turkish Tobacco |
| C: | Conventional Blend |

TABLE II

| | Blends | | | Differentials[1] | | |
|---|---|---|---|---|---|---|
| | Fire-End | Filter-End | Pocket | Density[2] | Nicotine[3] | Nicotine/Density[4] |
| A | 100% LDHN | 100% HDLN | Fire | +105.1 | −69.5 | −37.4 |
| B | 75% LDHN<br>25% HDLN | 25% LDLN<br>75% HDLN | Fire | +40.8 | −51.7 | −32.0 |
| C | 50% LDHN<br>50% HDLN | 50% LDLN<br>50% HDLN | Fire | +7.4 | −38.8 | −34.2 |
| D | 75% LDLN<br>25% HDLN | 25% LDHN<br>75% HDLN | Fire | +48.6 | +15.9 | +71.6 |
| E | 100% LDLN | 100% HDLN | Fire | +108.6 | −23.9 | +58.9 |
| F | 100% LDHN | 100% HDLN | Filter | +110.6 | −68.6 | −33.8 |
| G | 75% LDHN<br>25% HDLN | 25% LDLN<br>75% HDLN | Filter | +67.8 | −56.8 | −27.4 |
| H | 50% LDHN<br>50% HDLN | 50% LDLN<br>50% HDLN | Filter | +30.2 | −29.8 | −8.6 |
| I | 75% LDLN<br>25% HDLN | 25% LDHN<br>75% HDLN | Filter | +45.3 | +10.9 | +61.1 |
| J | 100% LDLN | 100% HDLN | Filter | +133.4 | −21.8 | +82.8 |
| K | 50% HDLN, 25% LDHN, 25% LDLN | | N/A[5] | +11.5 | −2.2 | +9.2 |
| L | C | | N/A[5] | +15.3 | −1.1 | +13.9 |

Notes:

[1]Differentials are stated according to the convention $\frac{\text{filter-fire}}{\text{fire}}$. Thus, a positive differential indicates a higher value at the filter end, and vice-versa.

[2]Percent segment density (mg./cm$^3$ of tobacco).

[3]Percent segment nicotine differential (% of nicotine in tobacco).

[4]Percent segment nicotine concentration (mg. nicotine/cm$^3$ tobacco).

[5]Non-segmented cigarettes.

TABLE III

WEIGHT, DENSITY, AND NICOTINE DATA
(MEAN VALUES - N-150)

| | FIRE | | | | | FILTER |
|---|---|---|---|---|---|---|
| | SEGMENT WEIGHT (gms) | SEGMENT DENSITY (gm/cm$^3$) | NICOTINE (%) | NICOTINE WEIGHT (mg) | SEGMENT NICOTINE CONCENT. (mg/cm$^3$) | SEGMENT WEIGHT (gms) |
| A | 0.2174 | 0.1554 | 3.31 | 7.20 | 5.14 | 0.4448 |
| B | 0.2787 | 0.1982 | 2.05 | 5.71 | 4.06 | 0.3906 |
| C | 0.3222 | 0.2286 | 1.65 | 5.32 | 3.77 | 0.3443 |
| D | 0.2710 | 0.1940 | 1.07 | 2.90 | 2.08 | 0.4025 |
| E | 0.2157 | 0.1543 | 1.17 | 2.52 | 1.80 | 0.4499 |
| F | 0.2254 | 0.1618 | 3.25 | 7.32 | 5.26 | 0.4765 |
| G | 0.2545 | 0.1822 | 2.6 | 6.00 | 4.30 | 0.4290 |
| H | 0.2933 | 0.2093 | 1.61 | 4.72 | 3.37 | 0.3823 |
| I | 0.2917 | 0.2082 | 1.10 | 3.21 | 2.29 | 0.4270 |
| J | 0.2035 | 0.1466 | 1.19 | 2.42 | 1.74 | 0.4800 |
| K | 0.3060 | 0.2204 | 1.39 | 4.25 | 3.06 | 0.3414 |
| L | 0.3100 | 0.2203 | 1.76 | 5.46 | 3.88 | 0.3567 |

TOTAL

TABLE III-continued

WEIGHT, DENSITY, AND NICOTINE DATA
(MEAN VALUES - N-150)

| | FILTER | | | | CIGARETTE | |
|---|---|---|---|---|---|---|
| | SEGMENT DENSITY (gm/cm$^3$) | NICOTINE (%) | NICOTINE WEIGHT (mg) | SEGMENT NICOTINE CONCENT. (mg/cm$^3$) | TOTAL NICOTINE WEIGHT (mg) | AVG. VOLUME NICOTINE CONCENT. (mg/cm$^3$) |
| A | 0.3188 | 1.01 | 4.49 | 3.22 | 11.69 | 4.18 |
| B | 0.2790 | 0.99 | 3.87 | 2.76 | 9.58 | 3.41 |
| C | 0.2455 | 1.01 | 3.48 | 2.48 | 8.8 | 3.12 |
| D | 0.2882 | 1.24 | 4.99 | 3.57 | 7.89 | 2.82 |
| E | 0.3218 | 0.89 | 4.00 | 2.86 | 6.52 | 2.33 |
| F | 0.3408 | 1.02 | 4.86 | 3.48 | 12.18 | 4.37 |
| G | 0.3058 | 1.02 | 4.38 | 3.12 | 10.38 | 3.71 |
| H | 0.2725 | 1.13 | 4.32 | 3.08 | 9.04 | 3.22 |
| I | 0.3025 | 1.22 | 5.21 | 3.69 | 8.42 | 2.99 |
| J | 0.3422 | 0.93 | 4.46 | 3.18 | 6.88 | 2.46 |
| K | 0.2458 | 1.36 | 4.64 | 3.34 | 8.89 | 3.2 |
| L | 0.2540 | 1.74 | 6.21 | 4.42 | 11.67 | 4.15 |

These tobaccos were used to blend twelve test cigarettes, as shown on Table II. It is important to understand that the percentages shown for each tobacco are percentages of volume, not weight, as weight is the normal basis for blending in the art. Varying quantities of the various tobaccos were used to create fire-end and filter-end blends for each of the products. Of these, cigarettes types A–J were manufactured on the Wahle manufacturing apparatus, as specially set up to manufacture these products; to provide additional variability in the data, cigarette types A–E were produced with the pocket in the fire-end segment, while cigarette types F–J were produced with the pocket in the filter end, as discussed above. Cigarette types K and L were control products, manufactured using conventional cigarette-making techniques. The blend of cigarette type K was a composite of the three selected tobaccos, and cigarette L contained a purely conventional cigarette blend.

These products were then tested both for their physical and chemical characteristics as well as for their smoking properties. Approximately 8,000–10,000 cigarettes of each of the twelve types were manufactured, and, of these, 150 of each type were randomly selected for a detailed analysis of their constituents. Table III lists detailed weight, density and nicotine data for each type of cigarette. The data shown in Table II reflects the average values of "Density" and "Nicotine" differentials for each type. Note that the measurement convention used in the tests results in a positive number if the higher value is in the filter-end segment and a negative number if the higher value is in the fire-end segment. It is also important to understand the difference between the data shown in the columns labelled "Nicotine" and "Nicotine/Density". The former represents the difference between the percentages of nicotine (by weight) in each segment, and the latter column lists the differences in nicotine concentration, which takes into account the density of the segment as well as the amount of nicotine. Thus, the first column is the measure of the nicotine differential, and the second can be employed as a diagnostic tool. If the density differential provides the predominant effect, this number will be highly positive ($>+70$); if the nicotine differential overrides, the number will be highly negative ($<-40$); if the two effects interrelate, the number may be positive or negative, but will fall between $+70$ and $-40$). The data in the "Nicotine" column do not include many values near zero; this effect stems from the fact that the percentage nicotine content of tobacco is a relatively low number, as reflected in Table III.

Further, it should be noted that some differential appears even in products manufactured by conventional (non-segmented) techniques. As illustrated in the data for cigarette types K and L, the apparatus that controls tobacco rod weight does not achieve perfectly uniform density along the tobacco rod, owing to the flow characteristics of shredded tobacco. From any given portion of a tobacco rod to another portion, density may vary by $\pm$10–20%.

Eighty randomly selected test products of each type were then smoked on conventional smoking apparatus using techniques known in the art, and the smoke obtained from each puff was subjected to chemical analysis. FIGS. 2–5 plot the resulting data to yield puff-by-puff analyses of the nicotine content of the smoke in each puff, and Table IV sets out the numerical results and the variation in results for different replications of the test.

Figure 2:
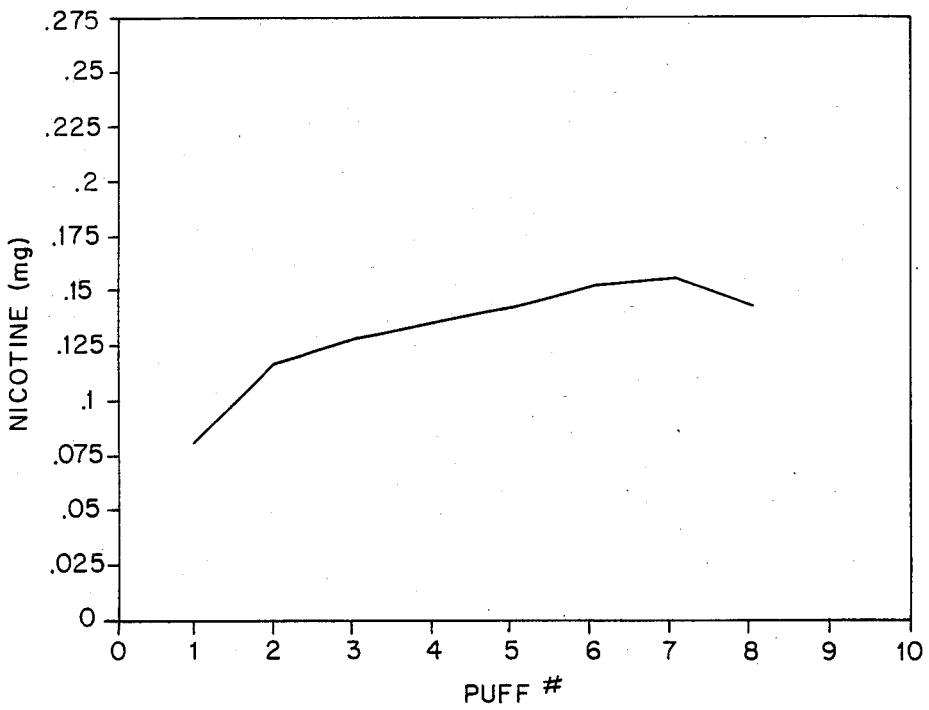
FIG. 2 is a graphic representation of the average nicotine delivery of the smoke obtained from each puff of a conventional cigarette.
Figure 3:
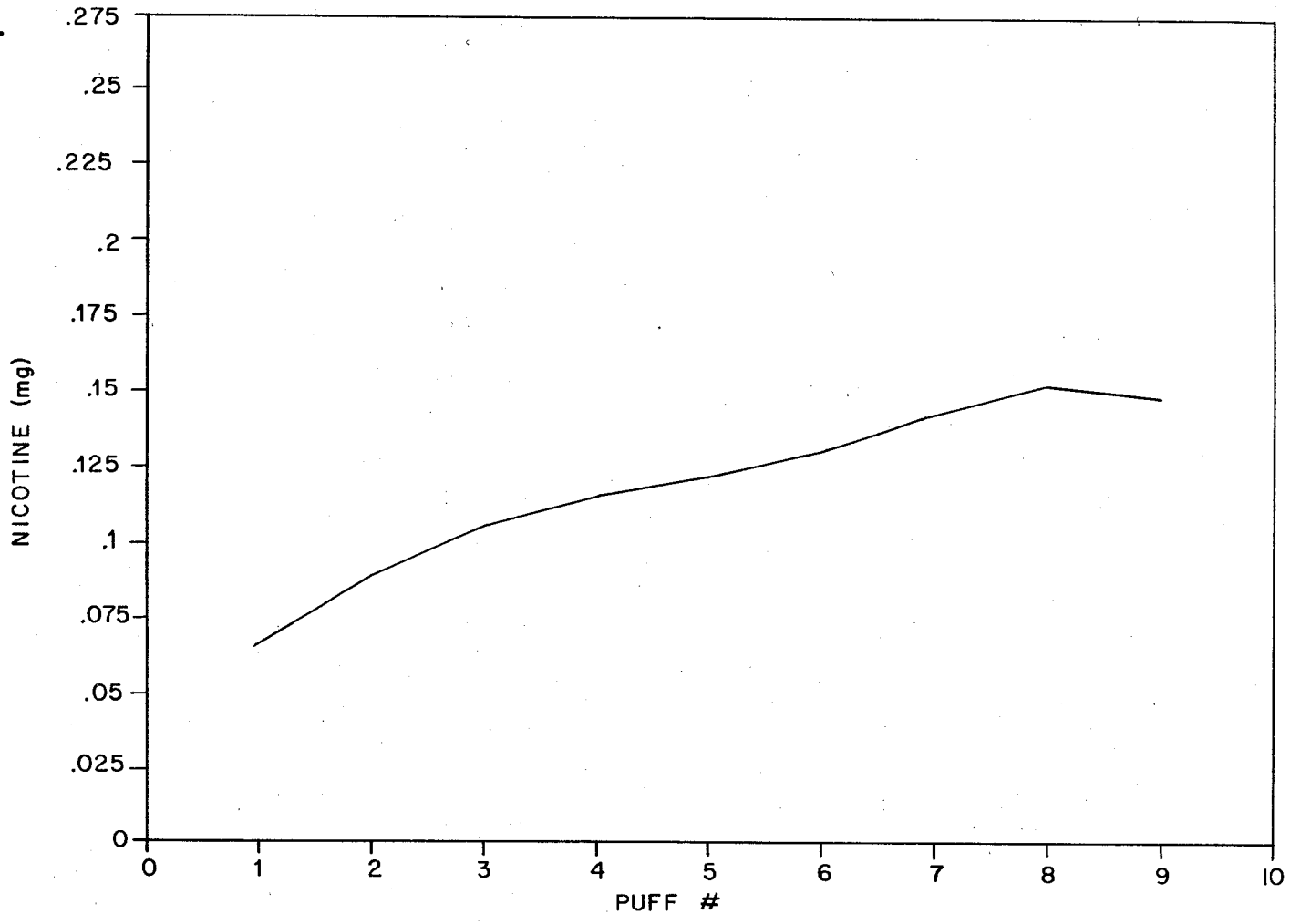
FIG. 3 is a graphic representation of the average nicotine delivery of the smoke obtained from each puff of a cigarette type whose tobacco blend is a composite of selected tobaccos used in evaluating the present invention.

FIG. 2 shows the puff-by-puff nicotine curve for the conventional-type cigarette, test product type L. As discussed above, the shape of this curve is generally linear, trending upwardly. Thus, the smoker experiences increasing nicotine deliveries with each succeeding puff, resulting in a perception of increased "harshness" as the cigarette is smoked. As mentioned above, it is this perception that the invention ovecomes through delivery modification. As shown in FIG. 3, the special composite blend selected for this test performed exactly like a conventional blend when manufactured as a conventional product. Again, the puff-by-puff nicotine curve exhibits a generally linear, upwardly trending shape.

TABLE IV

| | Puff # | [1]Nicotine (mg/puff) | [2]D |
|---|---|---|---|
| PD00146 A | 1 | .145 | 0.004 |
| | 2 | .214 | 0.008 |
| | 3 | .222 | 0.008 |
| | 4 | .184 | 0.007 |
| | 5 | .148 | 0.002 |
| | 6 | .131 | 0.007 |
| | 7 | .119 | 0.004 |
| | 8 | .115 0.001 | |
| | 9 | .106 | 0.001 |
| | | | Avg D = 0.005 |
| B | 1 | .086 | 0.010 |
| | 2 | .139 | 0.001 |

TABLE IV-continued

| | Puff # | [1]Nicotine (mg/puff) | [2]D |
|---|---|---|---|
| | 3 | .162 | 0.005 |
| | 4 | .160 | 0.003 |
| | 5 | .149 | 0.002 |
| | 6 | .133 | 0.003 |
| | 7 | .124 | 0.002 |
| | 8 | .127 | 0.004 |
| | 9 | .123 | 0.005 |
| | | | Avg D = 0.004 |
| C | 1 | .074 | 0.006 |
| | 2 | .097 | 0.007 |
| | 3 | .117 | 0.002 |
| | 4 | .123 | 0.000 |
| | 5 | .121 | 0.001 |
| | 6 | .121 | 0.004 |
| | 7 | .123 | 0.004 |
| | 8 | .119 | 0.002 |
| | 9 | .132 | 0.008 |
| D | 1 | .044 | 0.004 |
| | 2 | .071 | 0.002 |
| | 3 | .084 | 0.004 |
| | 4 | .092 | 0.000 |
| | 5 | .111 | 0.001 |
| | 6 | .116 | 0.003 |
| | 7 | .124 | 0.006 |
| | 8 | .129 | 0.003 |
| | 9 | .130 | 0.002 |
| | | | Avg D = 0.003 |
| E | 1 | .052 | 0.001 |
| | 2 | .076 | 0.007 |
| | 3 | .086 | 0.000 |
| | 4 | .085 | 0.001 |
| | 5 | .083 | 0.004 |
| | 6 | .086 | 0.005 |
| | 7 | .085 | 0.002 |
| | 8 | .092 | 0.001 |
| | 9 | .077 | 0.001 |
| | | | Avg D = 0.002 |
| F | 1 | .094 | 0.008 |
| | 2 | .221 | 0.008 |
| | 3 | .250 | 0.007 |
| | 4 | .212 | 0.003 |
| | 5 | .148 | 0.006 |
| | 6 | .122 | 0.003 |
| | 7 | .115 0.005 | |
| | 8 | .110 | 0.003 |
| | 9 | .100 | 0.002 |
| | | | Avg D = 0.01 |
| G | 1 | .097 | 0.008 |
| | 2 | .149 | 0.001 |
| | 3 | .173 | 0.004 |
| | 4 | .180 | 0.007 |
| | 5 | .166 | 0.009 |
| | 6 | .142 | 0.001 |
| | 7 | .126 | 0.004 |
| | 8 | .126 | 0.006 |
| | 9 | .120 | 0.001 |
| | | | Avg D = 0.004 |
| H | 1 | .084 | 0.003 |
| | 2 | .116 | 0.004 |
| | 3 | .131 | 0.005 |
| | 4 | .138 | 0.002 |
| | 5 | .139 | 0.000 |
| | 6 | .126 | 0.000 |
| | 7 | .120 | 0.001 |
| | 8 | .123 | 0.000 |
| | 9 | .128 | 0.010 |
| | | | Avg D = 0.003 |
| I | 1 | .045 | 0.000 |
| | 2 | .065 | 0.002 |
| | 3 | .074 | 0.005 |
| | 4 | .083 | 0.007 |
| | 5 | .097 | 0.004 |
| | 6 | .108 | 0.006 |
| | 7 | .111 | 0.006 |
| | 8 | .119 | 0.001 |
| | 9 | .102 | 0.000 |
| | | | Avg D = 0.003 |
| J | 1 | .048 | 0.007 |
| | 2 | .075 | 0.003 |
| | 3 | .087 | 0.001 |
| | 4 | .085 | 0.003 |

TABLE IV-continued

| | Puff # | [1]Nicotine (mg/puff) | [2]D |
|---|---|---|---|
| | 5 | .078 | 0.000 |
| | 6 | .076 | 0.004 |
| | 7 | .077 | 0.001 |
| | 8 | .075 | 0.001 |
| | 9 | .065 | 0.002 |
| | | | Avg D = 0.002 |
| K | 1 | .066 | 0.002 |
| | 2 | .089 | 0.003 |
| | 3 | .105 | 0.001 |
| | 4 | .115 | 0.006 |
| | 5 | .122 | 0.003 |
| | 6 | .130 | 0.006 |
| | 7 | .142 | 0.005 |
| | 8 | .152 | 0.001 |
| | 9 | .148 | 0.000 |
| | | | Avg D = 0.003 |
| L | 1 | .082 | 0.009 |
| | 2 | .118 | 0.002 |
| | 3 | .129 | 0.004 |
| | 4 | .136 | 0.002 |
| | 5 | .143 | 0.010 |
| | 6 | .153 | 0.002 |
| | 7 | .156 | 0.008 |
| | 8 | .144 | 0.004 |
| | | | Avg D = 0.005 |

[1]Average of two duplicate runs consisting of 40 cigarettes each.
[2]Difference between two duplicate runs (for nicotine a difference >0.10 is considered to be "significant" although not in the statistical sense).

Figure 4:
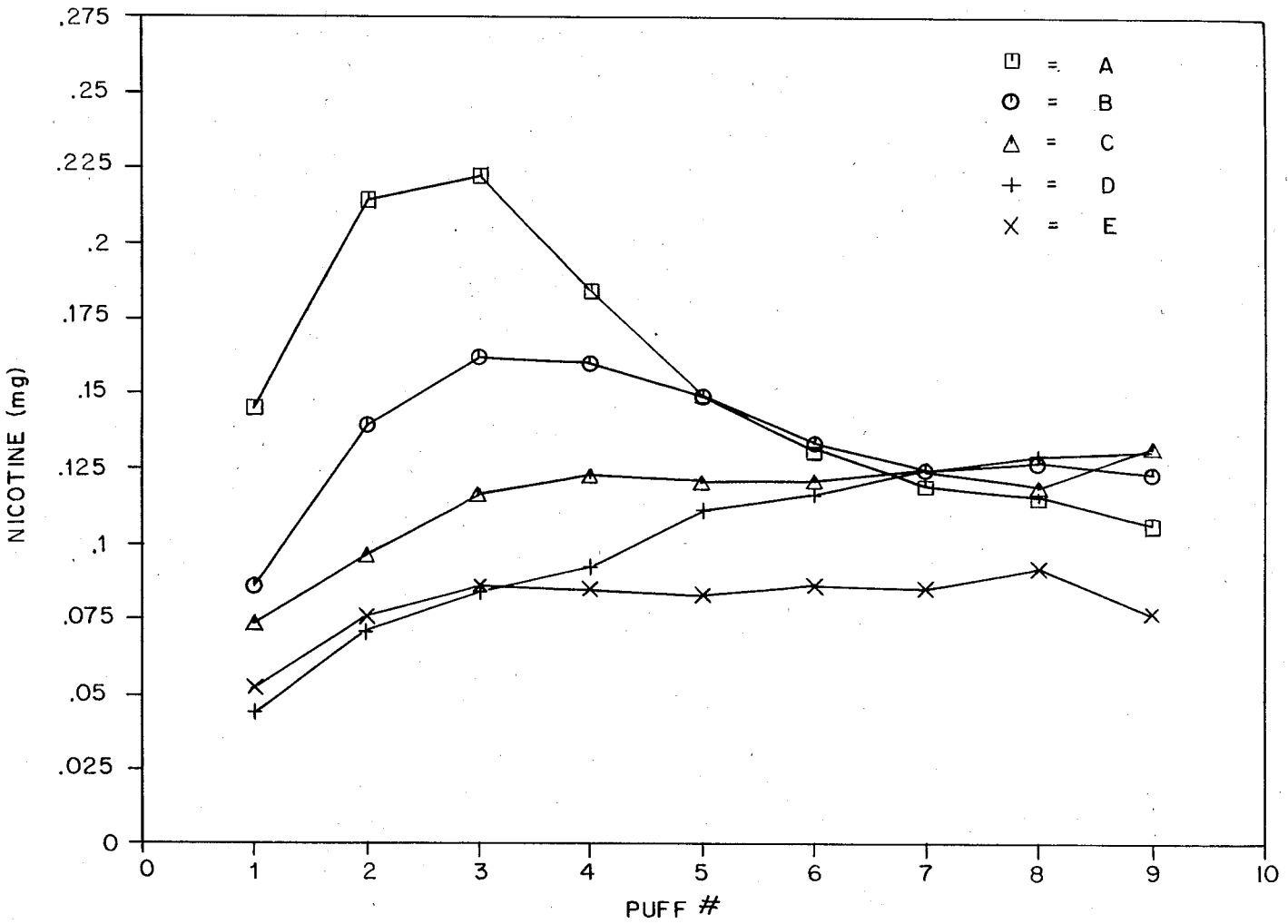
FIG. 4 is a graphic representation of the average nicotine delivery of the smoke obtained in each puff of five cigarette types A–E, specially manufactured to test the present invention.
Figure 5:
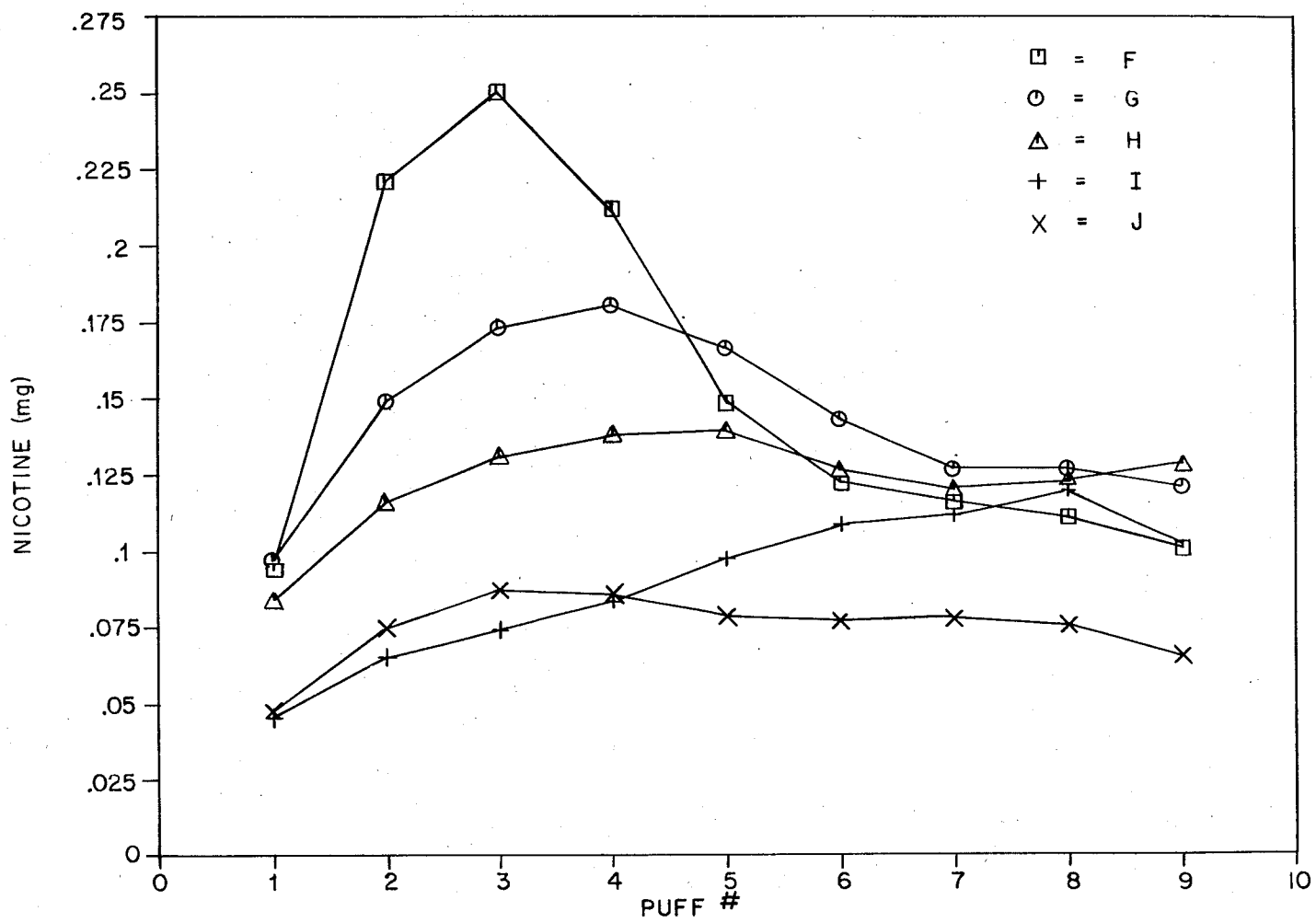
FIG. 5 is a graphic representation of the average nicotine delivery of the smoke obtained in each puff of five cigarette types F–J, specially manufactured to test the present invention.

FIGS. 4 and 5 show the puff-by-puff nicotine curves of the ten types of segmented cigarettes. The family of curves associated with the five product types having the pocket located in the fire end are grouped in FIG. 4, while the curves for the filter-end pocket product types are grouped in FIG. 5.

Three conclusions can be drawn from these data. First, the prior art was correct in identifying the result of a nicotine differential. Curve C in FIG. 4 shows the result for a product type having a high nicotine level in the fire end, a low nicotine level in the filter end, and essentially uniform density (indeed, the density differential between these two segments is within the control limits of conventional apparatus). Comparing that curve with the curve obtained from identical tobaccos in FIG. 3, one notes that the nicotine delivery trends upward for the first three puffs, then essentially flattens out. In terms of a smoker's perception, this product should behave like a conventional cigarette for the first few puffs, but then would not exhibit increasing "harshness" during the remainder of the cigarette.

Second, the data demonstrates the surprising result that density, considered alone, also produces a modification of nicotine delivery. Curve J, in FIG. 5 reflects the results of a product type of essentially uniform nicotine distribution, but having a higher density in the filter end than in the fire end segment. The high positive nicotine/density value indicates that the density effect governs this result. Again, comparing that curve with the results shown in FIG. 3, one sees an upwardly trending nicotine concentration for the first few puffs, followed by a flattening of the curve during the last half of the cigarette. Density differential unexpectedly permits the design of a cigarette that avoids the problem of increased "harshness" at the end of the cigarette.

Third, combining density and nicotine differentials allows one to alter radically a cigarette's nicotine delivery curve. The most dramatic illustration of this effect can be seen in curves A and F, FIGS. 4 and 5, respectively. Both of these product types are configured with the filter-end segment over 100% more dense than the fire-end segment, and both types have significantly greater nicotine levels in the fire-end segment. In these curves, the first three puffs show extremely high nicotine delivery, resulting in a perception of a "strong" cigarette. Thereafter, however, the nicotine delivery falls off dramatically, rapidly reaching levels at or below that of the first puff.

The opposite extreme is shown in curves D and I, where the density differentials are still present, but the nicotine differential is reversed, the filter end having a higher nicotine concentration than the fire end. There, the two effects virtually cancel one another out, producing a product type with a nicotine delivery virtually identical to the composite type shown in FIG. 3.

Further illustration of the importance of the density differential of present invention can be seen in comparing curves A and B, and F and G. There, the nicotine differential is the same for all of these product types; the density differential, however, varies from extremely high (product types A and F) to medium values (product types B and G). When the density differential is increased, however, the curve modification becomes radically different, as in curves A and F.

Taken together, these data point the way to cigarettes remarkably different from those now on the market. Those skilled in the art can use these results to design products whose nicotine deliveries are selected to meet stated consumer taste criteria. Understanding the effects that density differential has on the cigarette's delivery pattern, and the synergistic effect of combining that factor with a nicotine differential, one then can use well-known techniques of processing, blending and cigarette construction to design products that deliver consumer satisfaction more effectively.

The apparent lowest level of density differential necessary to produce the desired modification of smoking characteristic is immediately above the normal density differentials produced by the cigarette-making apparatus weight control mechanism. That mechanism establishes control over tobacco weight—and, therefore, density—in the plus or minus 10–20% range. Thus, curve H shows a definite smoking characteristic modification; yet the density differential is relatively low. As can be seen in comparing curves A, B and C, the modification becomes more marked as the density differential increases.

Figure 6:
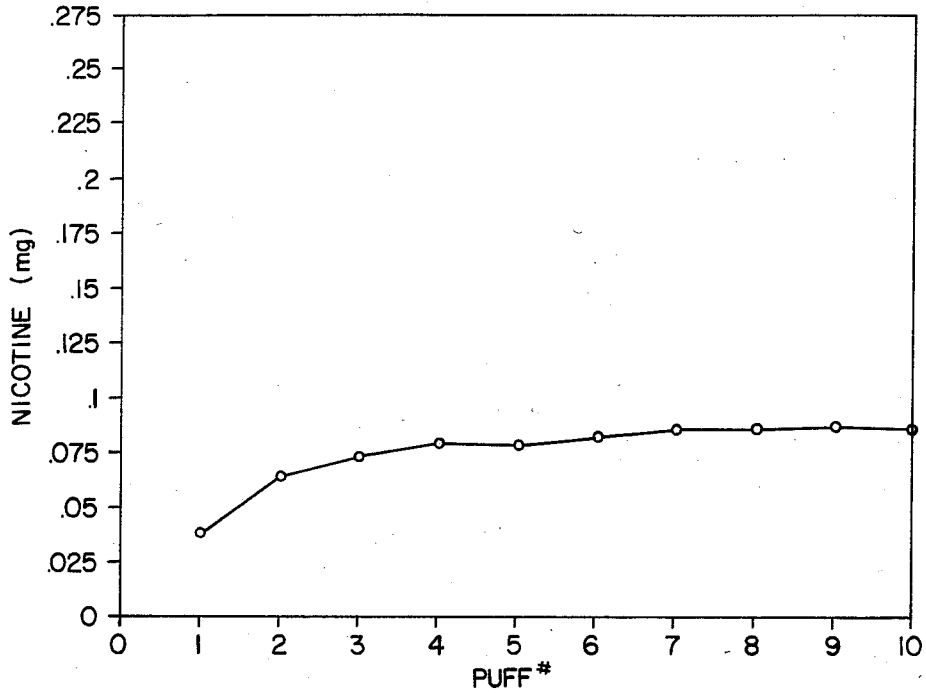
FIG. 6 is a graphic representation of the average nicotine delivery of the smoke obtained in each puff of Embodiment 1, specially manufactured to test the present invention.
Figure 7:
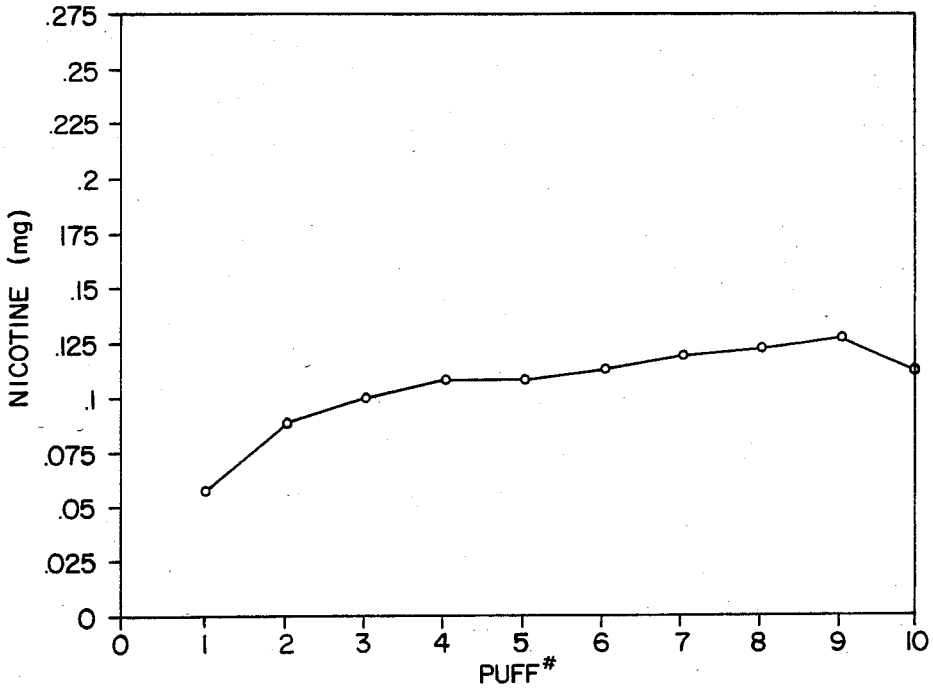
FIG. 7 is a graphic representation of the average nicotine delivery of the smoke obtained in each puff of Embodiment 2, specially manufactured to test the present invention.

FIGS. 6 and 7 plot the nicotine delivered per puff by the embodiments 1 and 2, respectively discussed above. In comparing these curves with the curve for a conventinal cigarette shown in FIG. 2, it is apparent that the invention produces the results predicted by the test data. The nicotine delivered in the first several puffs climbs rapdily, then levels off to substantially uniform delivery for the remainder of the cigarette. Thus, as predicted, the smoker should perceive the cigarette as being relatively "strong" in the early puffs, yet not "harsh" toward the last puffs.

Another important result of this invention is the ability to make segmented cigarettes using only one tobacco blend. Heretofore, the prior art has been uniform in teaching that segmented cigarettes require at last two different blends of tobacco in order to produce an effect. Here, however, the present invention shows that a density differential alone produces the desired modification of smoking characteristics. Therefore, one can place the same tobacco blend in each of the segments, to produce a single-blend, segmented cigarette. That process is, of course, diametrically opposed to the teachings of the prior art.

Of course, a wide variety of different products can be produced employing the present invention. For example, one could employ a tobacco substitute, either as a blend constituent or in pure form to make up one or both of the segments. The product may be produced with or without a filter. Also, one may produce either a filter or non-filter cigarette using this invention, as discussed above. Further, as also discussed above, one may use two discrete blends, or one may configure the cigarette with only one blend. The embodiment shown is the best mode known at the present time for practicing the invention, but does not limit application of the invention, which is defined solely by the claims appended hereto.

We claim:

1. A smoking article having a smokeable charge including fire end and an unlit end, comprising:
   - a first segment, disposed at the fire end of the smoking article having a substantially uniform density radially and longitudinally from the segment axis; and
   - a second segment having a substantially uniform density radially and longitudinally from the segment axis disposed at the unlit end of the cigarette and extending at least 30% of the total length of the smokable portion of the smoking article, said second segment having a density at least 20% greater than the density of said first segment.

2. The smoking article of claim 1, wherein said second segment has a density at least 30% greater than said first segment.

3. The smoking article of claim 1, wherein said second segment has a density at least 50% greater than said first segment.

4. The smoking article of claims 1, 2, or 3, wherein said first segment and said second segment are composed of the same tobacco blend.

5. The smoking article of claims 1, 2, or 3, wherein said first segment and said second segment are composed of different tobacco blends.

6. The smoking article of claim 5, wherein said first segment and said second segment are approximately the same length.

7. The smoking article of claim 5, wherein said second segment extends approximately 60% the length of the smokable portion of the cigarette.

8. The smoking article of claims 1, 2, or 3, wherein at least one of said segments includes a tobacco substitute material.

9. The smoking article of claim 1 wherein said substantially uniform longitudinal and radial densities of each of said first segment and said second segment occur beyond each dense end region.

10. The smoking article of claim 9 wherein said first segment extends at least 30% of the total length of the smokable portion of the smoking article.

11. The smoking article of claim 1 wherein said smoking article is a cigarette.

12. A smoking article having a smokeable charge including fire end and an unlit end, comprising:
   - a first segment having a substantially uniform density radially from and longitudinally along the segment axis, disposed at the fire end of the smoking article; and
   - a second segment disposed at the unlit end of the smoking article, said second segment extending at least 30% of the total length of the smokable portion of the article, said second segment having a density at least 20% greater than said first segment, and said first segment having a nicotine content higher than that of said second segment.

13. The smoking article of claim 12, wherein said second segment has a density at least 30% greater than said first segment.

14. The smoking article of claim 12, wherein said second segment has a density at least 50% greater than said first segment.

15. The smoking article of claims 12, 13, or 14, wherein said first segment and said second segment are composed of the same tobacco blend.

16. The smoking article of claims 12, 13, or 14, wherein said first segment and said second segment are composed of different tobacco blends.

17. The smoking article of claim 16, wherein said first segment and said second segment are approximately the same length.

18. The smoking article of claim 16, wherein said second segment extends approximately 60% the length of the smokable portion of the cigarette.

19. The smoking article of claims 13, 14, or 15, wherein at least one of said segments includes a tobacco substitute material.

20. The smoking article of claim 12 wherein said smoking article is a cigarette.

21. The smoking article of claim 20 wherein said unlit end is a filter end and said second segment axis is between said first segment and the filter end of the cigarette.

22. The smoking article of claim 12 wherein said substantially uniform longitudinal and radial densities of each of said first segment and said second segment occur beyond each dense end region.

23. The smoking article of claim 22 wherein said first segment extends at least 30% of the total length of the smokable portion of the smoking article.

24. The smoking article of claim 21 wherein said substantially uniform density of each of said first segment and said second segment occurs beyond each dense end region, and said first segment extends at least 30% of the total length of the smokable portion of the smoking article.

25. A method for producing a smoking article, said method comprising the steps of:

selecting a first tobacco segment;

selecting a second tobacco segment having a density at least 20% greater than said first segment;

forming a tobacco rod from said first and second segments, said first segment occupying at least 30% of the length of said tobacco rod and positioned at the fire end of said tocacco rod; and said second segment positioned at the unlit end of the cigarette.

26. The method of claim 25, wherein said second tobacco segment has a density at least 30% greater than said first segment.

27. The smoking article of claim 26 wherein said unlit end is a filter end and said second segment axis is between said first segment and the filter end of the cigarette.

28. The smoking article of claim 27 wherein said substantially uniform density of each of said first segment and said second segment occurs beyond each dense end region, and said first segment extends at least 30% of the total length of the smokable portion of the smoking article.

29. The method of claim 25 wherein said smoking article is a cigarette.

30. The method of claim 29 wherein said second segment is positioned between said first segment and the filter end of said cigarette.

31. The method of claim 29 wherein said second segment occupies at least 30% of the length of said tobacco rod.

* * * * *